US008011069B1

(12) United States Patent
Klein

(10) Patent No.: US 8,011,069 B1
(45) Date of Patent: Sep. 6, 2011

(54) BABY APPLIANCE SUPPORT

(76) Inventor: April H. Klein, Palestine, TX (US)

( * ) Notice: Subject to any disclaimer, the term of this patent is extended or adjusted under 35 U.S.C. 154(b) by 1001 days.

(21) Appl. No.: 11/712,343

(22) Filed: Feb. 28, 2007

(51) Int. Cl.
*A44B 21/00* (2006.01)

(52) U.S. Cl. ..... 24/302; 24/3.11; 24/3.13; 224/194

(58) Field of Classification Search ..... None
See application file for complete search history.

(56) References Cited

U.S. PATENT DOCUMENTS 4,765,037 A * 8/1988 Perry ..... 24/301

* cited by examiner

*Primary Examiner* — Jack W. Laivnder

(57) ABSTRACT

An innovative baby appliance support makes it possible to keep baby's pacifier (and other appliances) clean while in use. The support features a strap with clasps at each end. The strap, which may or may not feature an adjustable length, features at least one clasp tab. In use, one clasp of the device is affixed to the child's clothing, while the other is looped around the pacifier handle and applied to the clasp tab. When used in such a manner, the support will frequently wholly prevent the pacifier or other appliance from falling and contacting the ground when it is dropped from the child's mouth.

6 Claims, 2 Drawing Sheets

BABY APPLIANCE SUPPORT

FIELD OF THE INVENTION

This invention relates to baby appliances.

BACKGROUND OF THE INVENTION

A Critical Need: A Clean, Safe Environment for Our Children.

Being a good parent is hard work. From the moment a newborn is brought home, his or her new parents are hard at work learning everything they can about how to provide the care the child needs in order to thrive.

Certainly, there is much to learn. Parents of newborn children will learn more than they ever thought imaginable about the child's stages of development, nutrition, breastfeeding, burping (yes burping), baby equipment (cribs, car seats, carriers, etc.), sleep patterns, crying, teething, diapers and toilet training, language development, and motor skill and emotional development, to say nothing of illnesses and emergencies.

One oft-overlooked area of importance to the young child is simply this: cleanliness. A clean, hygienic living environment for your child can make all the difference in the world regarding just how much time your child spends healthily and heartily exploring the world around him/her versus how much time is spent in the doctor's waiting room waiting for relief from the latest infection. Thus, time spent washing hands, the floor, and the diaper changing area especially, is time very well spent.

However, no matter how careful the child's parents are, one potential source of infection will arise time after time after time. The infant, in the course of his or her usual playtime activities, will knock the pacifier out of mouth and onto the floor. Even when the floor is newly cleaned, the sound of the pacifier, a device which resides in his or her mouth, striking the floor is a sound that one never quite gets used to.

Certainly, most parents will frequently wash the pacifier off, but the frequency with which this happens compels the notion that both the child and the parents would be better off if, somehow, the frequency with which the pacifier falls all the way to the ground could be reduced. Furthermore, every parent can also tell numerous stories about pacifiers that have totally disappeared even though the home in which they are raising their child, at this time of their lives, is modest in size.

What is needed is a convenient way to keep baby's pacifier (and other baby appliances) close at hand and, if at all possible, clean as well. Furthermore, as any caregiver can attest, child care is multitasking; the preferred product solution to the above-referenced problems should also be configurable to provide support to bibs, booties, and all of the other appurtenances that are a part of a child's every day life.

It is to these needs that the instant patent application is directed.

BRIEF SUMMARY OF THE INVENTION

An innovative baby appliance support makes it possible to keep baby's pacifier (and other appliances) cleaner while in use than ever before. The support features a strap with clasps at each end. The strap, which may or may not feature an adjustable length, features at least one clasp tab.

In use, one clasp of the device is affixed to the child's clothing, while the other is looped around the pacifier handle and applied to the clasp tab. When used in such a manner, both mother and father can rest assured that the pacifier will never be far from the child and may, in fact, be close enough at hand that the child himself/herself is able to locate it and replace it in his or her mouth when desired.

Nicely enough, the innovative support disclosed herein can also provide support for myriad other purposes as well. Bibs, booties, and all of the other paraphernalia that accompanies life with a child can all be supported using the novel invention described below.

DETAILED DESCRIPTION OF THE INVENTION

Figure 1:
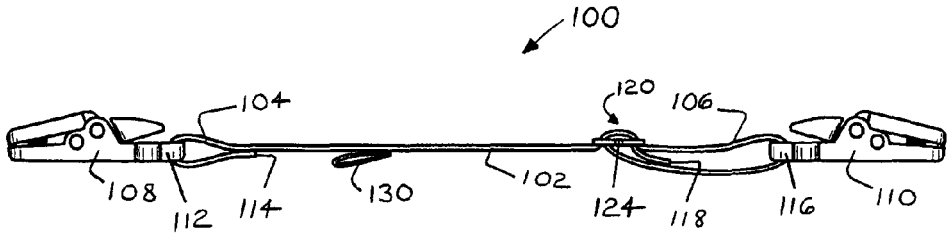
FIG. 1 is a front view of a baby appliance support manufactured in accordance with the teachings of this disclosure.
Figure 2:
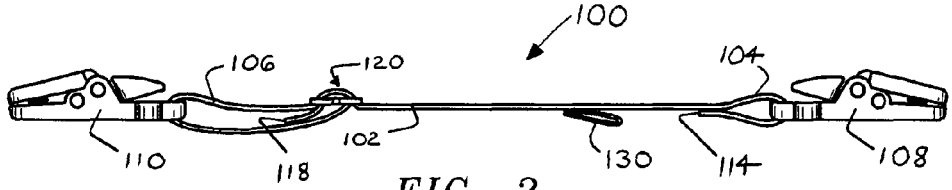
FIG. 2 is a rear view of the baby appliance support shown in FIG. 1.

Referring, now, to FIG. 1 and FIG. 2, a baby appliance support 100 is shown. The baby appliance support 100 comprises a strap 102 which itself comprises a first end 104 and a second end 106. The first end 104 is attached to a first clasp 108, and the second end 106 is attached to a second clasp 110.

The method by which the clasps are attached to their respective ends merits a brief comment.

Figure 3:
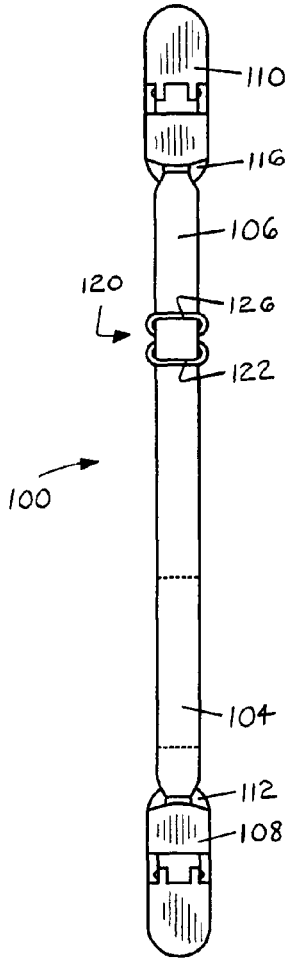
FIG. 3 is a top view of the baby appliance support of FIG. 1.

First clasp 108 features a closed handle 112 (as best seen in FIG. 3). The first terminal 114 of first end 104 is looped (i.e., passed through and around) the closed handle 112 and sewn or otherwise secured back upon first end 104.

The second clasp 110 could be attached to second end 106 in a similar (or any equivalent) fashion.

However, in the embodiment shown in the figures, the second clasp 110 is attached to second end 106 in such a manner that the effective length of the strap 102 is adjustable. Specifically, strap 102 is passed through (and secured to) an adjustment buckle 120. The adjustment buckle 120 shown is a substantially flat member featuring a first collar 122, an axle 124, and a second collar 126. See FIG. 3 (identifying first collar 122 and second collar 126); FIG. 1 (identifying axle 124).

Returning to FIGS. 1-2, strap 102 (specifically, second terminal 118 of strap 102) passes under first collar 122, over axle 124, and again under second collar 126. It then passes around/through closed handle 116 of second clasp 110 (or, to phrase it differently, "loops" around/through closed handle 116) and then is secured to axle 124. Specifically, the terminus 118 of second end 106 loops the axle 124 and is then sewn or otherwise secured to second end 106.

So configured, adjustment buckle 120 imparts adjustability to the length of strap 102. Specifically, when a user holds the baby appliance support 100 in hand, allowing slack in the strap 102, one can easily slide adjustment buckle 120 along the length of the strap and, in so doing, expand or contract the effective length of the strap 102.

Although the first clasp 108 is shown fixedly attached to the first end 104, and the second clasp 110 is attached to the second end 106 by means of the adjustment buckle 120, these assignments could be reversed (so that adjustment of the effective length of strap 102 occurs through the interaction of first end 104 and first clasp 108). Alternatively, if strap 102 length adjustment is deemed unnecessary, the adjustment buckle 120 could be omitted. Furthermore, one could employ an adjustment buckle at both ends 104, 106.

Of course, the adjustment buckle 120 is but one mechanism that could be employed to effectuate adjustment of strap 120 length. Persons of ordinary skill in the art will appreciate a variety of mechanisms that could be employed to provide a strap 102 whose effective length is adjustable (including mechanisms which do not employ adjustment buckles interacting with clasp handles as shown herein).

Furthermore, although one simple means for attaching the clasps 108, 110 to their respective ends 104, 106 has been shown, any equivalent method of attachment could be utilized such as, for example, adhesive, fasteners, staples, velcro, ties, or clamps.

Returning, now, to FIGS. 1-2, it will be observed that the baby appliance support 100 also features the use of at least one clasp tab 130 located on the strap 102 at a position proximate to the first end 104. The clasp tab(s) 130 fulfill an important purpose and impart a unique functionality to the invention.

Specifically, the clasp tab 130 allows the user of the device to loop the first clasp 108 through the handle of a baby appliance to be supported (baby appliance not shown), so that the first clasp 108 can then be applied to (that is, clasped to) clasp tab 130. Thus, the clasp tab 130 will frequently be located near one of the ends (and perhaps as close as one to three clasp lengths from the ends).

As an example, many pacifiers used with very small children feature a closed handle. The baby appliance support 100 can be used to support such a pacifier by applying second clasp 110 to the back of the child's clothing (perhaps, for example, to clothing or other materials tailored to the child near the back of the neck) and then looping first clasp 108 through the pacifier handle and then securing the clasp 108 to the clasp tab 130. If the child should open his or her mouth, dropping the pacifier, it very likely will not touch the ground, because of the action of the inventive baby appliance support 100 disclosed herein.

Figure 4:
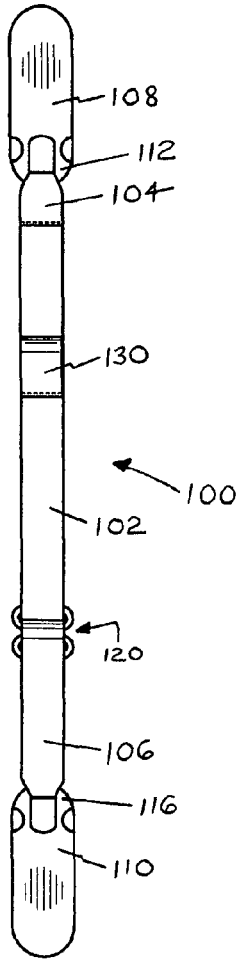
FIG. 4 is a bottom view of the baby appliance support of FIG. 1.
Figure 7:
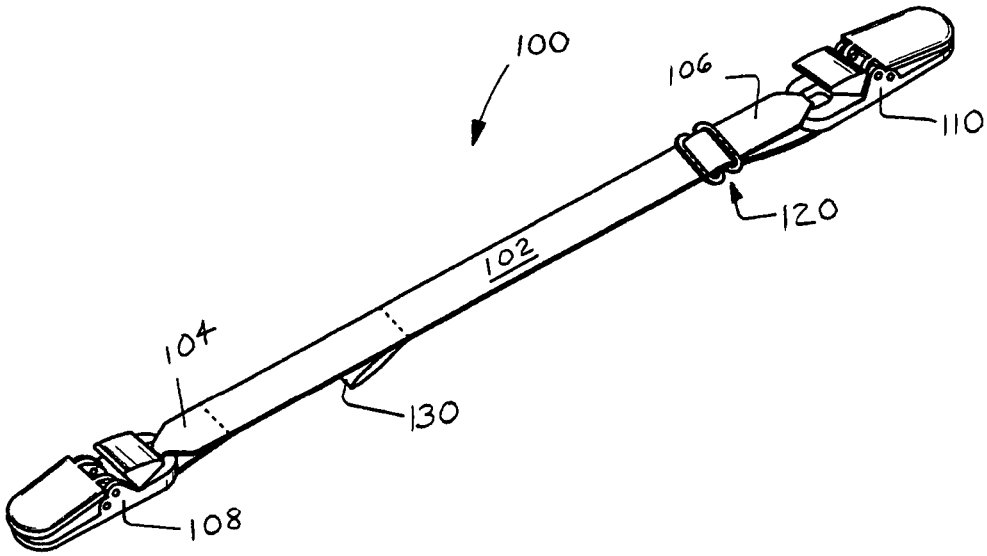
FIG. 7 is a perspective view of the baby appliance support of FIG. 1.

Turning, now, to FIG. 3, FIG. 4, and FIG. 7, it will be appreciated that the strap 102 should be of such a length, width, and thickness as to be effective for its intended purpose. Most baby appliances, such as pacifiers, are fairly light; however, even they feature a modest weight, and, because they will be tossed about by the active child on the go, straps 102 suitable for use in the invention should generally be fabricated from fabrics, cloths, ribbons, or materials which are durable (but nonetheless comfortable in direct contact with the skin). Certainly, the strap 102 may be (but is certainly not required to be) fashioned of elastic materials as well.

Regarding the appropriate length of the strap 102 for the instant application, it has been discovered that a length of strap 102 which is between about thirty percent and one hundred twenty percent of the circumference of the head of a child with which the baby appliance support 100 will be used is effective; in fact, the narrower percentage range of about forty percent to one hundred percent is even more desirable (with fifty percent to ninety percent being perhaps the most desirable range of all), because these narrower ranges not only proximately secure the appliance, but, in addition, minimize the distance between the appliance and the child's head.

Turning, now, to FIG. 5, FIG. 6, FIG. 8, FIG. 9, and FIG. 10, the attentive reader will appreciate the fact that the clasps play a critically important role in the design of the invention. A variety of clasp designs are effective, and persons of ordinary skill in the art will appreciate the nuances which distinguish effectual clasp designs from ineffectual ones.

The presence of a clasp locking feature may well be deemed desirable. That is, clasps that can be closed/clamped about a swatch of clothing or clasp tab without readily opening (or springing open under the influence of some kind of spring or biasing member) after the closing force is removed are desirable.

Figure 8:
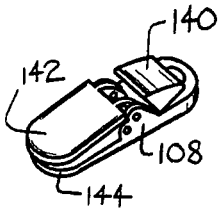
FIG. 8 is a front perspective view of a representative clasp of the baby appliance support of FIG. 1, the clasp being in a closed, clasping position.
Figure 9:
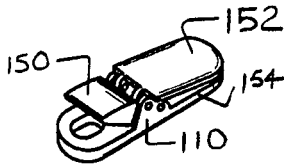
FIG. 9 is a rear perspective view of a representative clasp of the baby appliance support of FIG. 1, the clasp being in a closed, clasping position.
Figure 10:
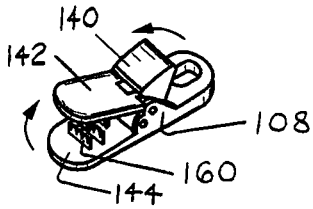
FIG. 10 is a front perspective view of a representative clasp of the baby appliance support of FIG. 1, the clasp being in an open, unclasped position.

It will be appreciated that the clasps shown in FIGS. 8-10 are not just locking clasps. These clasps 108, 110 also feature a compress-to-close functionality. That is, for example, referring to first clasp 108, as shown in FIG. 8 and FIG. 10, when first clasp actuator 140 is depressed/compressed onto its base, first clasp upper jaw 142 closes down upon first clasp lower jaw 144, gently locking into place. Once the jaws 142, 144 are locked into place, a modicum of force must be applied to the actuator 140 in the reverse direction, as shown in FIG. 10, to unlock and open the jaws 142, 144.

Compress-to-close functionality is useful where baby appliance-related applications are concerned, because infants are rough and tumble users to say the least. No reader will be surprised to learn that infants crawl into things, over things, under things, rolling left, right, and over in the process. If the infant should roll over onto his or her back, compress-to-close functionality increases the probability that the jaws 142, 144 will not be opened by the application of additional compressive force upon the actuator 140.

Figure 5:
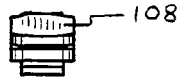
FIG. 5 is a left side view of the baby appliance support of FIG. 1.
Figure 6:
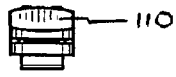
FIG. 6 is a right side view of the baby appliance support of FIG. 1.

For similar reasons, and as depicted in FIG. 5 and FIG. 6, clasps 108, 110 which feature a smooth, substantially flat exterior surface when closed are desirable, again for the reason that such a clasp will be much less uncomfortable bearing directly against the body of the infant child user.

Finally, it is the inventor's belief that safety should always be a paramount concern in the design of any appliances used with or near children. In this case, it is believed that the manufacturer of the invention may well want to instantiate into the design of the clasps a maximum sliding clasping/grasping force of at or about two pounds (ninety-one one-hundredths kilogram) so as to eliminate any potential choking hazard. Definitional note: the sliding clasping/grasping force refers not to the clamping force exerted by the teeth of the clasp upon one another, but, rather, to the sliding/transverse force which the clasp could overcome when applied under standard conditions to a swatch of fabric of the type used for children's clothing. The key here is not so much the specific numerical force figure, but, rather, satisfying a key safety-related design objective, namely, ensuring that if, somehow, the two ends of the invention 100 became clasped to the child or some other object in such a way that the strap 102 was positioned so as to choke the child, then the clasps should be insufficiently strong by design to impart any substantial choking force.

As demonstrated hereinabove, the baby appliance support 100 shown herein is particularly well-adapted to securing a child's pacifier. However, it is also extraordinarily well-adapted to securing other baby appliances as well. It can easily be used to secure napkins, burp cloths, paper towels, and the like to baby's clothing or carrier. Even booties, mittens, and other of baby's myriad items of support equipment can be secured.

A cautionary note: the circumference and force measurements referenced herein are based on the limited, but good faith, experimentation conducted to date. Although the figures cited herein are believed to be safe, effective, and efficient, the manufacturer will doubtless want to conduct additional testing to confirm good parameters for a commercial device meeting all desired criteria.

Although the invention has been described with reference to a preferred embodiment, this description should not be construed in a limiting sense. Various permutations and modifications of the disclosed embodiments, including its various enumerated features, as well as alternative embodiments of the invention, will become apparent to persons skilled in the art upon reference to this specification.

I claim:

1. A baby appliance support comprising:

(a) a strap comprising a first end and a second end;

(b) a first clasp attached to said first end;

(c) a second clasp attached to said second end; and (d) a clasp tab attached to said strap at a location proximate to said first end wherein a sliding clasping force of at least one of said clasps is no greater than two pounds (ninety-one one-hundredths kilograms) so as to eliminate any potential choking hazard.

2. A baby appliance support comprising:

(a) a strap comprising a first end and a second end;

(b) a first clasp attached to said first end;

(c) a second clasp attached to said second end; and (d) at least one clasp tab attached to said strap at a location proximate to one of said ends wherein a sliding clasping force of at least one of said clasps is no greater than two pounds (ninety-one one-hundredths kilograms) so as to eliminate any potential choking hazard.

3. A method of securing an appliance to a baby wearing clothing, said method comprising:

(a) looping a first clasp, said first clasp attached to a first end of a strap, about a closed handle of said appliance and closing said first clasp about a clasp tab affixed at a location proximate to said first end; and (b) closing a second clasp, said second clasp attached to a second end of said strap, to said clothing.

4. The method of claim 3 wherein said strap features a length which is adjustable.

5. The method of claim 3 wherein at least one of said clasps is a locking clasp featuring compress-to-close functionality.

6. The method of claim 3 wherein said strap is elastic.

* * * * *